US011285581B2

(12) United States Patent
Stanley et al.

(10) Patent No.: US 11,285,581 B2
(45) Date of Patent: Mar. 29, 2022

(54) HAND TOOL

(71) Applicant: Stanley Medical Designs, Inc., North Bay Village, FL (US)

(72) Inventors: Anthony G. Stanley, North Bay Village, FL (US); Morgan Hill, Westlake, OH (US)

(73) Assignee: Stanley Medical Designs, Inc., North Bay Village, FL (US)

( * ) Notice: Subject to any disclaimer, the term of this patent is extended or adjusted under 35 U.S.C. 154(b) by 0 days.

(21) Appl. No.: 16/430,601

(22) Filed: Jun. 4, 2019

(65) Prior Publication Data

US 2019/0366516 A1 Dec. 5, 2019

Related U.S. Application Data

(60) Provisional application No. 62/680,051, filed on Jun. 4, 2018, provisional application No. 62/703,556, filed on Jul. 26, 2018.

(51) Int. Cl.

| | |
|---|---|
| ***B25B 7/14*** | (2006.01) |
| ***B25B 7/22*** | (2006.01) |
| ***B25B 7/10*** | (2006.01) |

(52) U.S. Cl.

CPC ..... *B25B 7/22* (2013.01); *B25B 7/10* (2013.01); *B25B 7/14* (2013.01)

(58) Field of Classification Search

CPC .. B25B 7/14; B25B 7/22; B26B 17/00–17/02; B26B 13/00–13/285

See application file for complete search history.

(56) References Cited

U.S. PATENT DOCUMENTS

| | | | | |
|---|---|---|---|---|
| 2,012,648 A | | 8/1935 | Wheeler | |
| 2,123,357 A | * | 7/1938 | Carl | A45D 29/02 30/28 |
| 2,281,189 A | | 4/1942 | Wright | |
| 2,295,385 A | * | 9/1942 | Connors | A01G 3/02 30/124 |
| 3,842,500 A | | 10/1974 | Cassel | |

(Continued)

FOREIGN PATENT DOCUMENTS

| | | | |
|---|---|---|---|
| DE | 247761 C | * | 6/1912 |
| JP | 49-45883 Y1 | * | 12/1974 |

OTHER PUBLICATIONS

Stanley, Dr. Anthony G.; International Patent Application No. PCT/US15/44976; International Search Report; dated Nov. 23, 2015; 2 pages.

(Continued)

*Primary Examiner* — Stephen Choi
(74) *Attorney, Agent, or Firm* — Dority & Manning, P.A.

(57) ABSTRACT

A hand tool includes a head comprising a pair of opposing jaws. Each jaw includes a cutting edge. The hand tool also includes a first handle and a second handle which pivot through a first plane to move the hand tool between an open position and a closed position. In some embodiments, the hand tool also includes a lock pivotable between a locked position and an unlocked position through a second plane distinct from the first plane. In some embodiments, the hand tool also includes a basket having a first basket section removably attached to one of the pair of jaws and a second basket section removably attached to the other of the pair of jaws.

18 Claims, 17 Drawing Sheets

(56) References Cited

U.S. PATENT DOCUMENTS

| | | | | |
|---|---|---|---|---|
| 4,464,837 | A | 8/1984 | Amstuz | |
| 4,567,656 | A * | 2/1986 | Wallace | B26B 13/16 30/262 |
| D313,334 | S | 1/1991 | Novak | |
| 5,033,195 | A | 7/1991 | Appelkvist et al. | |
| 5,301,431 | A | 4/1994 | Cera | |
| 5,365,625 | A | 11/1994 | Han | |
| 5,383,274 | A | 1/1995 | Miller | |
| 5,619,892 | A | 4/1997 | Eggert | |
| 5,653,029 | A | 8/1997 | Shigenaka | |
| 5,659,958 | A | 8/1997 | Goings | |
| 6,324,712 | B1 | 12/2001 | Elsener, Sr. | |
| 7,021,177 | B2 | 4/2006 | Lovemark | |
| 7,111,376 | B2 | 9/2006 | Lombardi et al. | |
| 7,424,777 | B2 | 9/2008 | Namvar | |
| 8,522,443 | B2 | 9/2013 | Latronico et al. | |
| 2005/0022633 | A1 | 2/2005 | Rozo | |
| 2006/0236548 | A1 | 10/2006 | Namvar | |
| 2007/0157473 | A1 | 7/2007 | Varnell | |
| 2007/0163126 | A1* | 7/2007 | Huang | A01G 3/02 30/175 |
| 2009/0078278 | A1 | 3/2009 | Tran | |
| 2009/0149868 | A1 | 6/2009 | Shelton et al. | |
| 2009/0241342 | A1 | 10/2009 | Habib | |
| 2009/0293686 | A1 | 12/2009 | Pfab | |
| 2016/0059427 | A1* | 3/2016 | Stanley | A61B 17/8863 30/124 |
| 2016/0271759 | A1* | 9/2016 | Tsunoda | B26B 17/00 |

OTHER PUBLICATIONS

Stanley, Dr. Anthony G.; International Patent Application No. PCT/US15/44976; Written Opinion of the International Searching Authority; dated Nov. 23, 2015; 4 pages.

Aven website; http://www.aveninc.com/avens-complete-pfoduct-line/tools/pliers-and-cutteis/accu-cut-premium-pliers-and-cutters/accu-cut-xl-oval-head-cutter-2#.U-IOlmd3uM8 ; webpage printed Sep. 25, 2015; (4 pages).

Ted Pella, Inc website; http://www.tedpella.com/tools_html/cutters.htm#_oval ; webpage printed Sep. 25, 2015; (8 pages).

Stanley pliers #89-858 Fat Max—3 Photos. Printed Sep. 25, 2015; (3 pages).

Knipex diagonal cutters; http://www.zoro.com/knipex-diagonal-cuttecs-7-14-in-74-12-160/i/G6419585/ ; webpage printed Sep. 25, 2015; (2 pages).

Lindstrom; PDF catalogue; p. 31; printed Sep. 28, 2015; http://www.google.com/url?sa=t&rct=j&q=&esrc=s&source=web&cd=8&ved=0CFAQFjAHahUKEwjmu7zAk5bHAhXEbD4KHSIOB4c&url=http%3A%2F%2FWWW.lindstromtools.com%2Fpdf_down.php&ei=djbEVeaoNMTZ-QGinJv4CA&usg=AFQiCNEngyRCOyvTghhtIGbVWqEtR5BsGw&bvm=bv.99804247,d.cWw.

Swanstrom Tools USA; http://www.swanstromtools.com/choose.htm ; printed Sep. 14, 2015; (4 pages).

* cited by examiner

HAND TOOL

PRIORITY STATEMENT

The present application claims priority to U.S. Provisional Patent Application Ser. No. 62/680,051, filed Jun. 4, 2018 and U.S. Provisional Patent Application Ser. No. 62/703,556, filed Jul. 26, 2018, which are incorporated by reference herein in their entirety.

BACKGROUND

The need often arises to remove a foreign object from a human or animal patient. In such cases, it is often necessary to cut materials of a relatively small cross section, e.g., 12-14 gauge or less, such as wires, nails/screws, fishhooks, body jewelry, and the like. Such foreign objects may need to be removed from patients due to, e.g., accidental impalement or due to infection at the site of intentionally embedded material, e.g., jewelry.

Common general-purpose wire cutters, e.g., such as may be found in a hardware store, are often used for removal of such foreign objects from a patient. The use of a general-purpose hand tool in a medical application may present health and safety issues. Time may be lost in treatment while the proper hand tool is located. All current wire cutters, medical or nonmedical, have no way to prevent cut pieces from becoming projectiles. Sterility of the tool is also an issue, as quickly cleaning the tool as provided may not be enough to ensure proper hygienic conditions for the patient. Moreover, tools designed for construction and home repair use are not always of the best design for use in a medical application. Wire cutters designed for home repair use often have thick and bulky jaws that impede visualization as well as handles that are difficult to close with suitable force in the close quarters of the medical procedure. For instance removal of a barbed hook from a patient may require forcing the barb through and out of the skin at a point distal from the entrance point, cutting off of the barb on the end of the hook, and then pulling the remains of the hook back out of the patient.

In all applications of the use of cutting tools, e.g., medical applications, home repair applications, construction applications, etc., the sudden release of the cut material can also be a problem. For instance, when cutting the barbed end off of a fishhook, the sudden release of the barb can cause the barb to fly through the air at a very high velocity. Similarly, when snipping the end off of a wire, nail, etc. at a construction site, the cut pieces can form high velocity projectiles that fly indiscriminately across the site. Such high velocity projectiles can be dangerous, particularly if they should happen to hit someone in the eye. Moreover, once these projectiles have landed, they can be difficult to find again, and may be stepped on, which can cause trauma to an unprotected foot and can cause floor damage if embedded in a shoe.

Accordingly, a hand tool with features for quickly, safely, and sanitarily removing foreign objects such as but not limited to nails, embedded fishhooks, surgical and nonsurgical wires and body jewelry from humans and animals would be useful. Additionally, a hand tool with features for collecting and holding the cut pieces of such foreign objects so that they do not become projectiles which may, e.g., endanger eyes, puncture skin, or inadvertently fall into deep body cavities once dislodged from the patient, would be useful.

BRIEF DESCRIPTION OF THE INVENTION

Aspects and advantages of the invention will be set forth in part in the following description, or may be apparent from the description, or may be learned through practice of the invention.

In one exemplary embodiment, a hand tool is provided. The hand tool includes a head comprising a pair of opposing jaws. Each jaw includes a cutting edge. The hand tool also includes a first handle and a second handle joined to the first handle at a pivot joint. The first handle and the second handle are joined at the pivot joint such that they are each rotatable relative to the other to move the hand tool between a closed position where the jaws are in contact and an open position where the jaws are spaced apart. The hand tool also includes a lock pivotably attached to one of the first handle and the second handle such that the lock is rotatable between a locked position where movement of the hand tool from the closed position to the open position is inhibited by the lock and an unlocked position where the lock does not interfere with relative rotation of the first handle and the second handle. The first handle and the second handle are rotatable between the open position and the closed position within and through a first plane. The lock is rotatable between the locked position and the unlocked position within and through a second plane, and the second plane is distinct from the first plane.

In another exemplary embodiment, a hand tool is provided. The hand tool includes a head comprising a first jaw having a first cutting edge and an opposing second jaw having a second cutting edge. The hand tool also includes a first handle and a second handle joined to the first handle at a pivot joint. The first handle and the second handle are joined at the pivot joint such that they are each rotatable relative to the other to move the hand tool between a closed position where the jaws are in contact and an open position where the jaws are spaced apart. The hand tool also includes a basket having a first basket section removably attached to the first jaw and a second basket section removably attached to the second jaw.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1C:
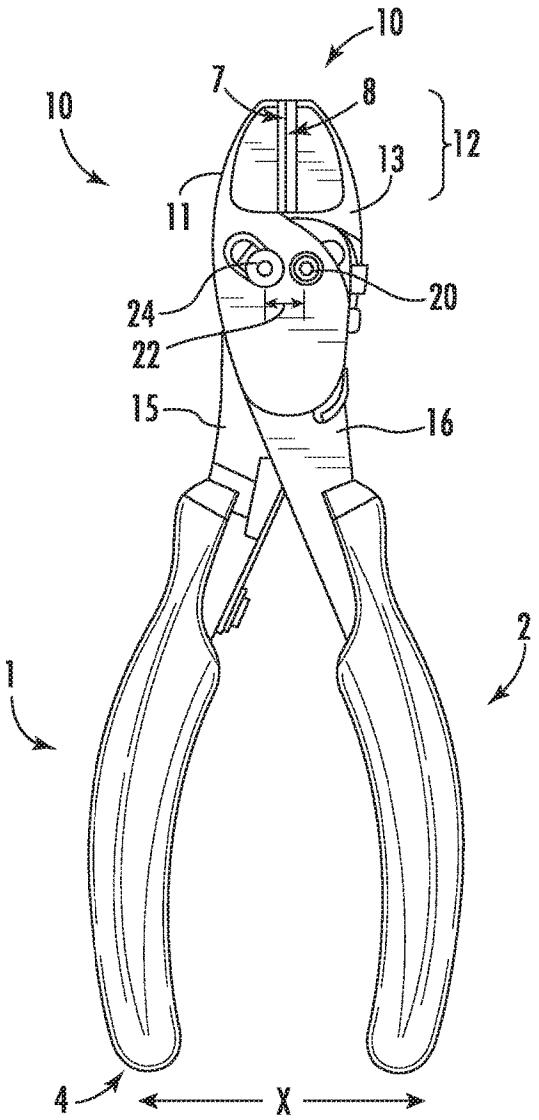
FIG. 1C provides a front view of a hand tool, e.g., a cutting tool, according to one or more further embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure is generally directed to a hand tool. Although the present disclosure is also applicable to hand tools generally, in some embodiments, the hand tool may be particularly useful in medical, dental, veterinary, and other similar fields. The hand tool of the present disclosure may include one or more advantageous features, such as a lock. In some embodiments, the lock may promote ease of use when locking and unlocking the hand tool. The hand tool may also include features which promote improved leverage, ease of access for cutting in tight spaces, and other features and additional benefits. The hand tool may catch and contain cut pieces with an attached basket device. The tool may be serializable and ergonomically designed for foreign body removal from various parts of the patient's body, such as skin surfaces, nose, nipples, external ear, and various body cavities. For example, additional features and advantages of the hand tool according to the present disclosure are described below and shown in the attached figures.

Figure 1B:
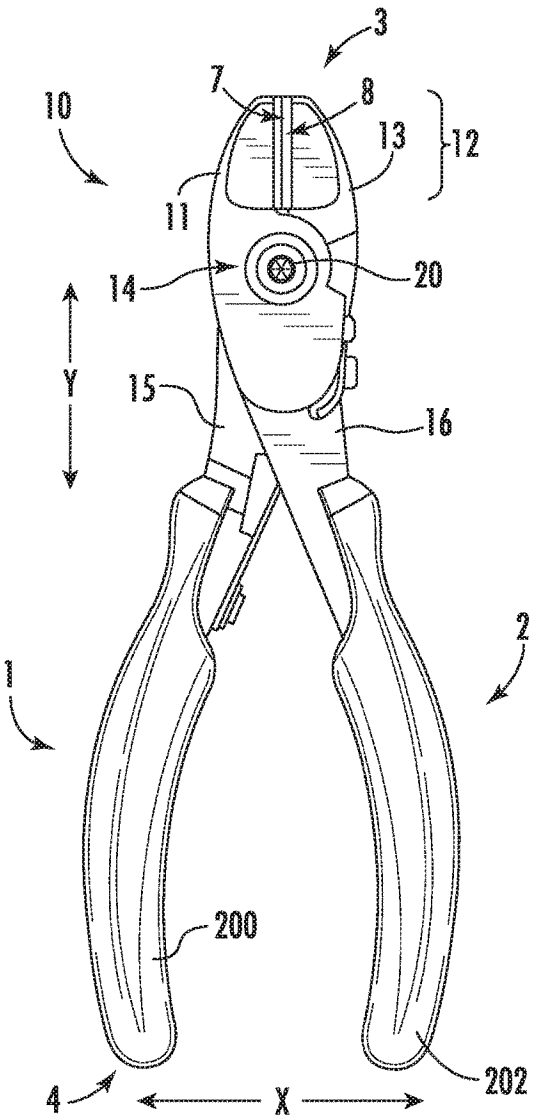
FIG. 1B provides a front view of a hand tool, e.g., a cutting tool, according to one or more additional embodiments of the present disclosure.
Figure 1A:
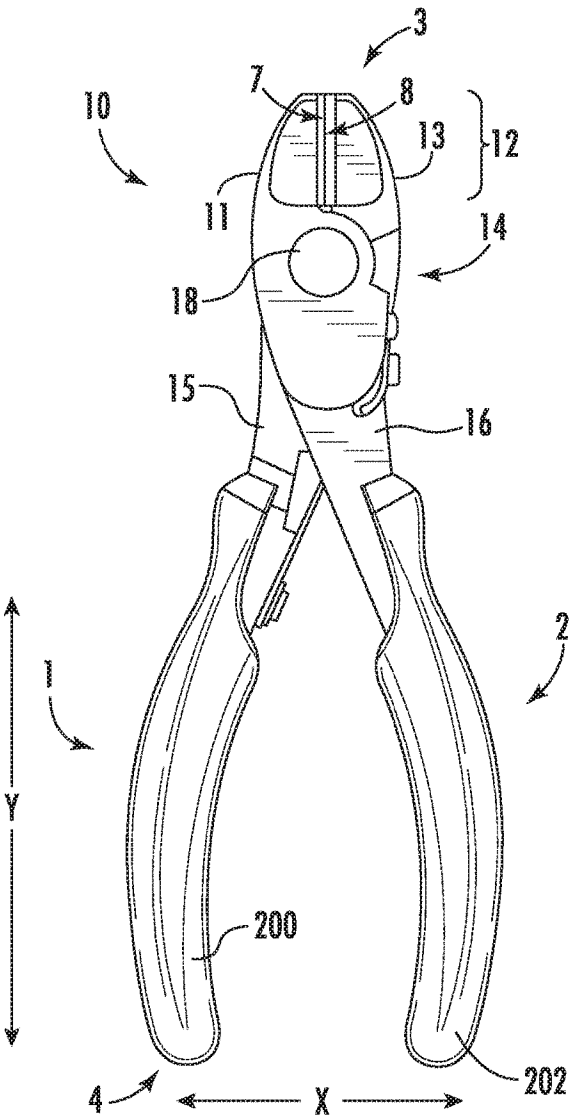
FIG. 1A provides a front view of a hand tool, e.g., a cutting tool, according to one or more embodiments of the present disclosure.
Figure 2:
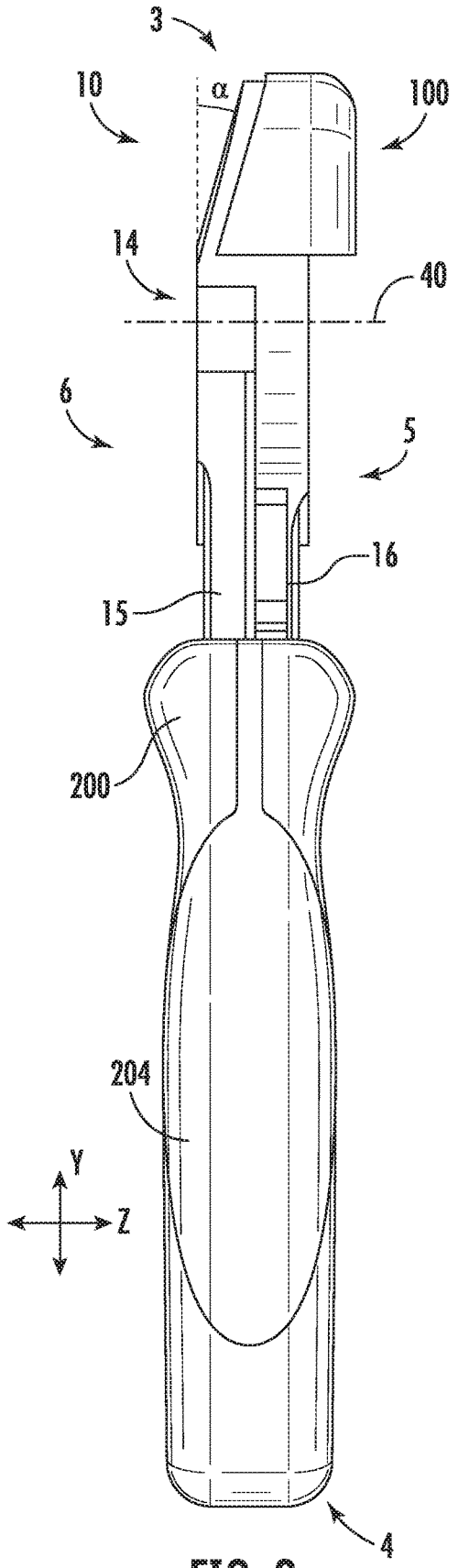
FIG. 2 provides a left side view of an exemplary hand tool according to one or more embodiments of the present disclosure.
Figure 3:
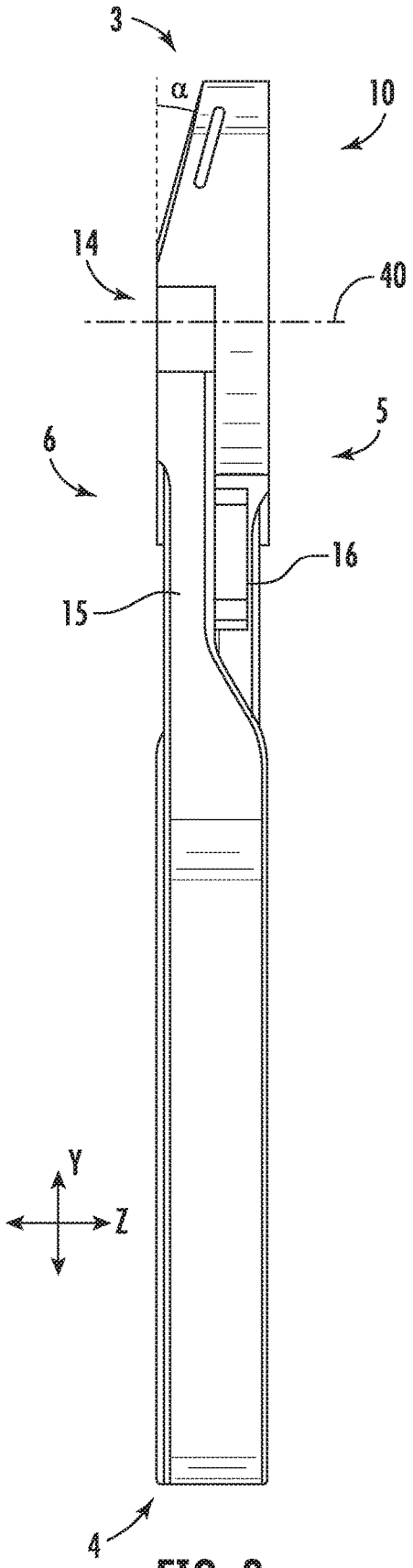
FIG. 3 provides a left side view of an exemplary hand tool according to one or more embodiments of the present disclosure.

FIGS. 1A, 1B, and 1C provide front views of a hand tool 10, e.g., a cutting tool, according to various embodiments of the present disclosure. FIGS. 2 and 3 provide left side views of the hand tool 10 according to one or more embodiments. As may be seen in FIGS. 1A through 3, the hand tool 10 extends between a left side 1 and a right side 2 along a lateral direction X, between an upper end 3 and a lower end 4 along a vertical direction Y, and between a front 5 and a back 6 along a transverse direction Z. The vertical direction Y, the lateral direction X, and the transverse direction Z are each mutually perpendicular, such that an orthogonal coordinate system is defined. The tool 10 generally includes a head 12 that in turn includes a left jaw 11 and a right jaw 13. Each jaw 11, 13 includes a cutting edge 7, 8, respectively. The tool 10 also includes a first handle, e.g., left handle 15 and a second handle, e.g., right handle 16 which are joined at a pivot joint 14, e.g., a hinge or pin joint. The handles 15 and 16 are pivotable about a pivot axis 40 (FIGS. 2 and 3) defined by the pivot joint 14, and are pivotable through and within a first plane, e.g., an X-Y plane defined by the lateral direction X and the vertical direction Y. The handles 15 and 16 are each connected to one of the jaws 11 and 13 such that when the handles 15 and 16 pivot about the joint 14, the jaws 11 and 13 move between a closed position (e.g., FIGS. 1A, 1B, 1C) where the jaws 11, 13 and in particular the cutting edges 7 and 8 thereof, are in direct contact and an open position (FIG. 12) where the jaws 11, 13, e.g., the cutting edges 7,8 thereof, are spaced apart. In use, an object to be cut may be placed between the cutting edges 7 and 8, e.g., the cutting edges 7 and 8 may be positioned on opposing sides of the object to be cut, and the jaws 11 and 13 may then be moved to the closed position, e.g., by squeezing the handles 15 and 16, whereby the object is engaged and cut by the jaws 11, 13 as the jaws 11, 13 close.

The cutting edges 7 and 8 can be formed of a hardened material that can hold an edge over a long period of time and can cleanly cut a metal. For example, the cutting edges 7, 8 can be formed of a hardened steel, such as a high-grade alloy steel or carbon steel including, without limitation, M2 high-speed carbon steel, W2 carbon tool steel, O1 alloy tool steel, CPM-M4 steel, D2 high chromium content tool steel, S30V stainless steel, 154CM stainless steel, ZDP-189 stainless steel, etc. The cutting edges can have a hardness on the Rockwell Hardness C scale of from about HRC 55 to about HRC 65, or from about HRC 60 to about HRC 65, or from about HRC 63 to about HRC 65 in some embodiments.

In one embodiment, at least the head 12 and joint 14 of the tool 10 can be formed of the material used to form the cutting edges. For instance, the tool 10 can be formed of a first unitary piece that forms right handle 16, a portion of the joint 14, and left jaw 11 and a second unitary piece that forms left handle 15, a portion of the joint 14, and right jaw piece 13. In such embodiments, these two unitary pieces can be held together in a rotating relationship at joint 14, for instance with an interlocking screw and nut or the like. Other materials, such as cushioning covers for the handles, described in more detail below, can also be employed. In one embodiment, the tool 10 can include disposable handle covers, which can provide for ease in sterilization with improved comfort during use. The handle covers may include features for improving a user's grip on the tool 10, for example, a knurled or knobby texture.

When considering the cutting tool for medical applications, all materials used to form the cutting tool can be sterilizable. Thus, the cutting tool can be sterilized and maintained for medical use, for instance as a component of a trauma kit, in a medical setting such as an emergency room, trauma unit, private doctor's office, medical clinic (e.g., urgent care facility), etc.

In the illustrated embodiments, the jaws 11 and 13 of the cutting tool 10 also include beveled surfaces that extend from the cutting edges 7, 8. The cutting edges 7, 8 can have any suitable edge shape including, without limitation, a semi-flush edge with a slight bevel, a flush edge with a minimum bevel, or a no bevel edge, as are generally known in the art. In one embodiment, the cutting edges can have a no bevel edge and can produce a cut with no pinch on the edge of the cut material. This edge shape may decrease the applied force necessary to produce the cut, which may prove beneficial. However, a hand tool having a bevel cutting edge may provide an improved, e.g., increased, cutting life.

In some embodiments, for example as illustrated in FIG. 1A, the hand tool 10 may include a fixed joint 14, e.g., the joint 14 may include a rivet 18 that is wedged into place, or the joint 14 may be otherwise permanently connected. In other embodiments, the tool 10 may include a removable joint 14 instead of the fixed joint 14 of FIG. 1A. For example as illustrated in FIG. 1B, the joint 14 may include a threaded fastener 20, e.g., an interlock screw 20 which interlocks with a mating part 26 (see, e.g., FIG. 9). In other example embodiments, the removable joint may include thumb screws or quick take apart features (e.g., a slot and post connection) to facilitate rapid and easy removal or disassembly of the joint 14. Embodiments including the removable joint 14, e.g., with the threaded fastener, may facilitate cleaning and sterilization of the tool 10 by providing the ability to non-destructively disassemble the tool 10 for cleaning and to re-assemble the tool 10 for further use after cleaning and/or sterilizing the tool 10. FIG. 1C illustrates a high-leverage hand tool 10 according to one or more embodiments of the present disclosure. As illustrated in FIG. 1C, in such embodiments the joint 14 may include a threaded fastener 20 offset from a high-leverage pin 24 by a fulcrum distance 22 to provide increased leverage between the handles 15, 16 and the jaws 11, 13 and thereby provide increased cutting force to the jaws 11 and 13.

The handles 15, 16 can be of a length to ensure adequate leverage by a user at the cutting edges 7, 8 of the cutting tool 10. For instance, the handles 15, 16 can generally be from about 3 inches to about 8 inches in length, or from about 4 inches to about 5.5 inches in some embodiments. The length of the handles 15, 16 can ensure that a user can firmly grip the cutting tool 10 across the width of their hand, thus spreading the pressure across the entire hand width and preventing a point force on the palm. Suitable length of the handles 15, 16 can also allow a user to engage all four fingers during use and increase compressive force at the cutting edges 7, 8.

The handles 15, 16 can also include a padded surface and one or more devices to improve grip, for example, handle covers 200 and 202 may be provided on the handles 15 and 16, respectively. The handle covers 200, 202 may improve grip and the ability to apply suitable compressive force at the jaws 11, 13, and in particular at the cutting edges 7, 8 thereof, so as to quickly and efficiently cut a material even when being used by someone with relatively small hands.

The handle covers 200, 202 can be formed of a soft, deformable material such as an elastomeric foam or other relatively soft elastomer that provides for easy and stable gripping of the handles 15 and 16. For instance, the handle covers 200, 202 can be formed of a natural or synthetic rubber or silicone elastomer that can optionally be in the form of a foam. The handle covers 200, 202 can generally be adhered to the surface of a metal handle 15 or 16 so as to prevent slipping during use. For instance, the handles 15 and 16 can be unitary with the joint 14 and head 12 of a cutting tool 10 and the handle covers 200 and 202 can each be adhered to a respective handle 15, 16 by use of, e.g., an adhesive or a melt bond. Alternatively, the handle covers 200, 202 can be simply held by a friction fit to the inner metal handles 15, 16. In some embodiments, the tool 10 can include disposable handle covers 200, 202 that can be attached to a handle 15 or 16 for use and then later removed. This can be of beneficial use in those embodiments in which a higher degree of sterility is desired, e.g., medical applications.

The handle covers 200, 202 can include a non-slip surface due to the nature of the material used to form the handle covers 200, 202. For instance, a latex or synthetic rubber composition can be molded to form the handle covers and upon formation can naturally include a somewhat rough surface to provide a non-slip grip to the handle covers. Additionally, a textured portion 204 (FIG. 2) may be provided on one or both covers 200 and 202, and the textured portion 204 may include any suitable texture, such as a knurled texture, for increasing the surface friction between the covers 200 and 202 and a user's hand, including, for example, when the user's hand is covered by a glove.

As shown, e.g., in FIGS. 2 and 3, the hand tool 10 may, in some embodiments, include a head tilt a. For example, the head 12 may be tilted at an angle $\alpha$ relative to the remainder of the tool 10, such as relative to the first plane through which the handles 15 and 16 rotate. For example, the head tilt angle $\alpha$ may be relative to the vertical direction Y. The angle $\alpha$ may be any suitable angle to promote ease of access in close quarters, e.g., when cutting a foreign object embedded in a patient's body, such as in a body cavity. The head tilt angle $\alpha$ may be between about ten degrees (10°) and about thirty degrees (30°), such as about fifteen degrees (15°). As used herein, "about" includes plus or minus twenty percent (20%) of the stated value, e.g., about ten degrees (10°) includes from eight degrees (8°) to twelve degrees (12°), and about fifteen degrees (15°) includes from twelve degrees (12°) to eighteen degrees (18°).

Figure 4:
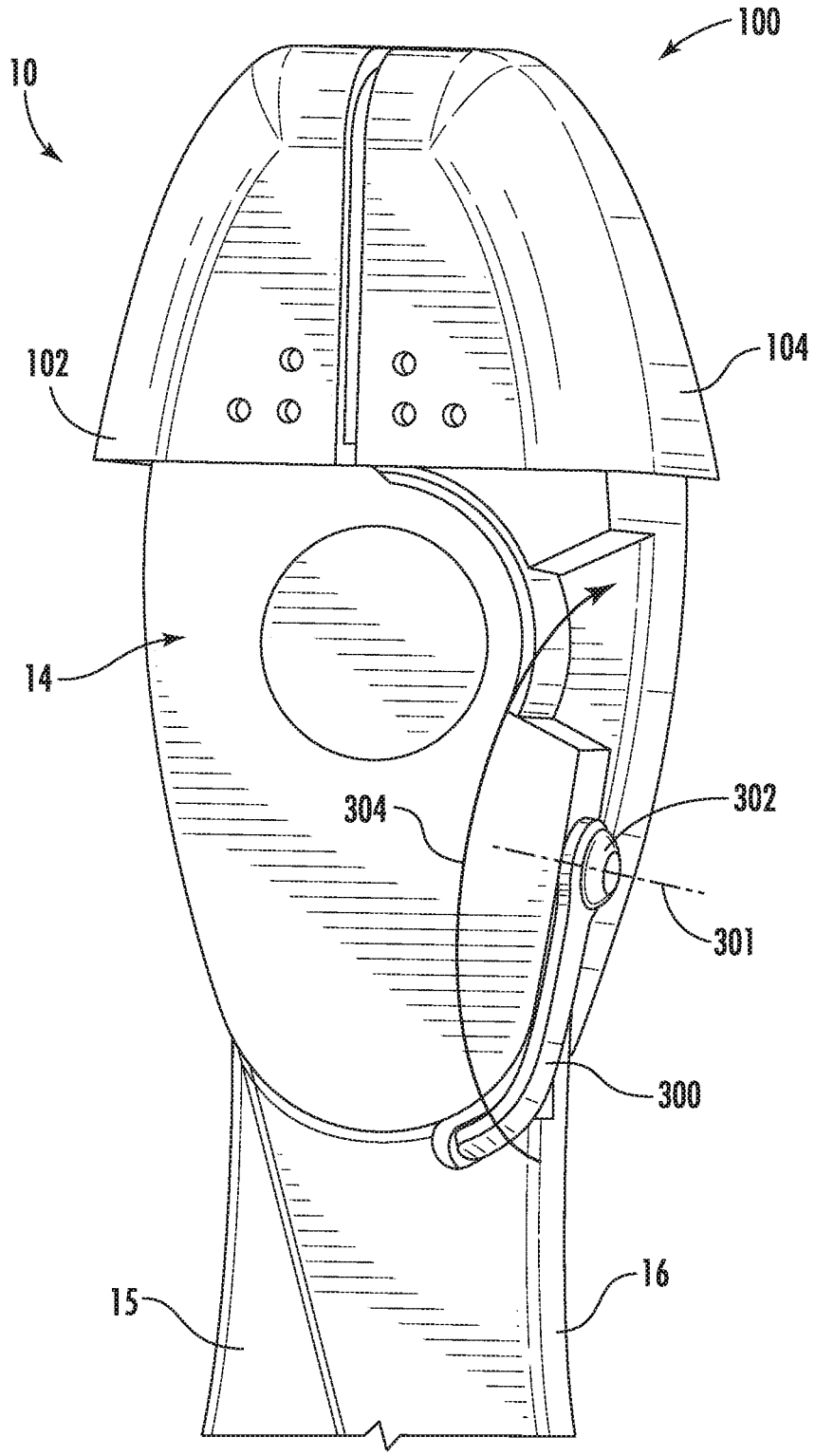
FIG. 4 is a perspective view of a portion of an exemplary hand tool according to one or more embodiments of the present disclosure with a lock in an unlocked position.
Figure 5:
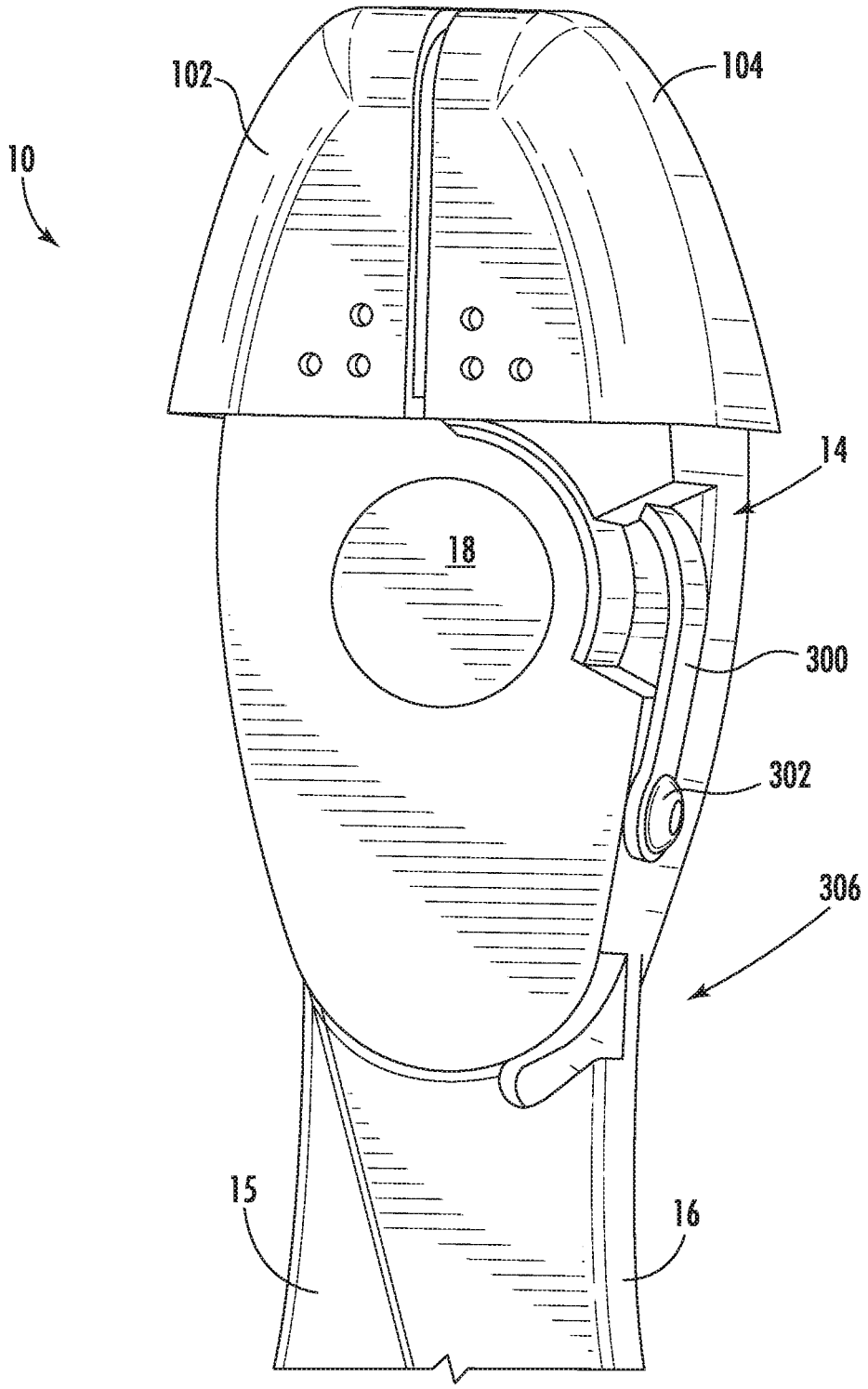
FIG. 5 is a perspective view of the hand tool of FIG. 4 with the lock in a locked position.
Figure 6:
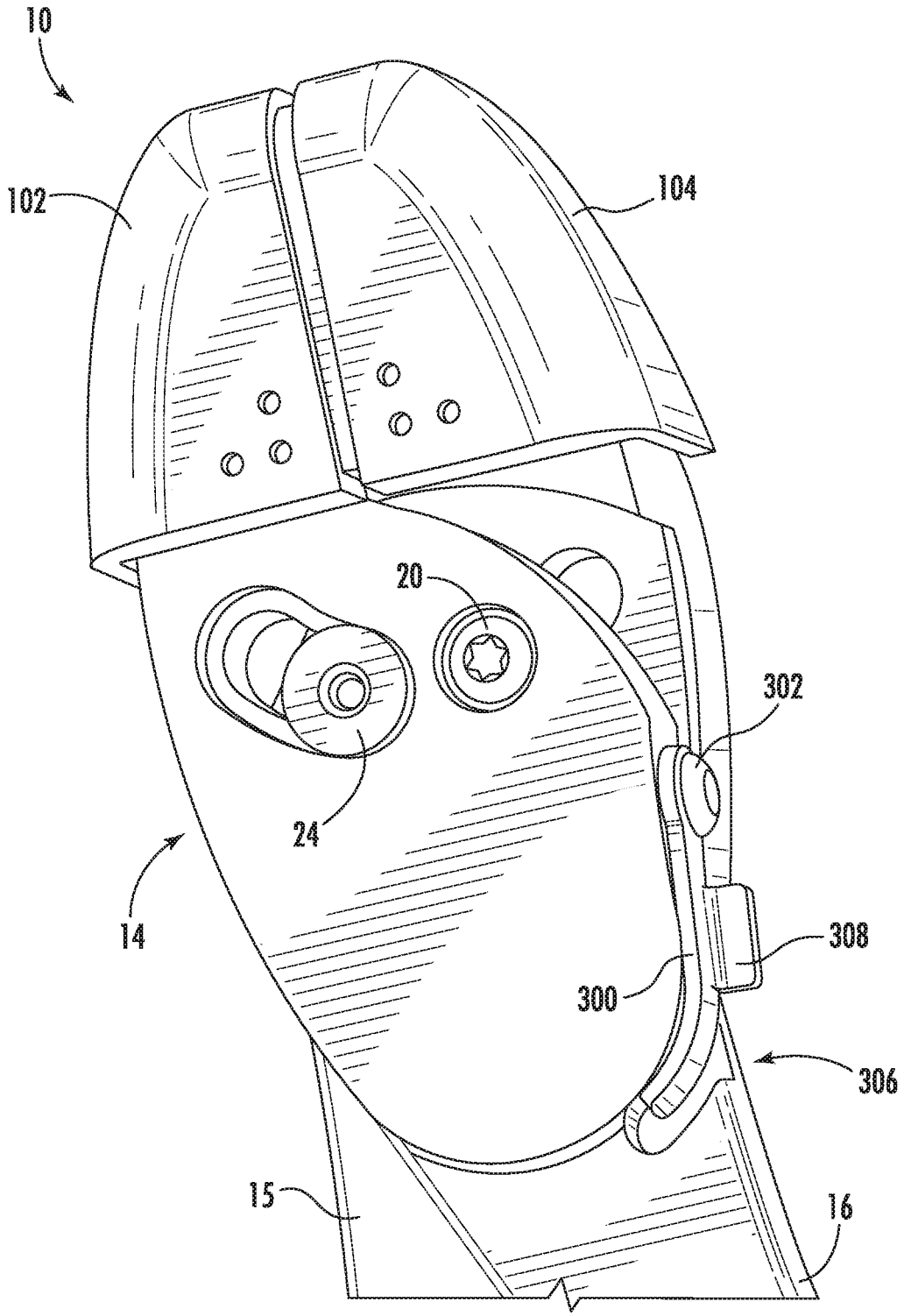
FIG. 6 is a perspective view of a portion of an exemplary hand tool according to one or more embodiments of the present disclosure with a lock in an unlocked position.
Figure 7:
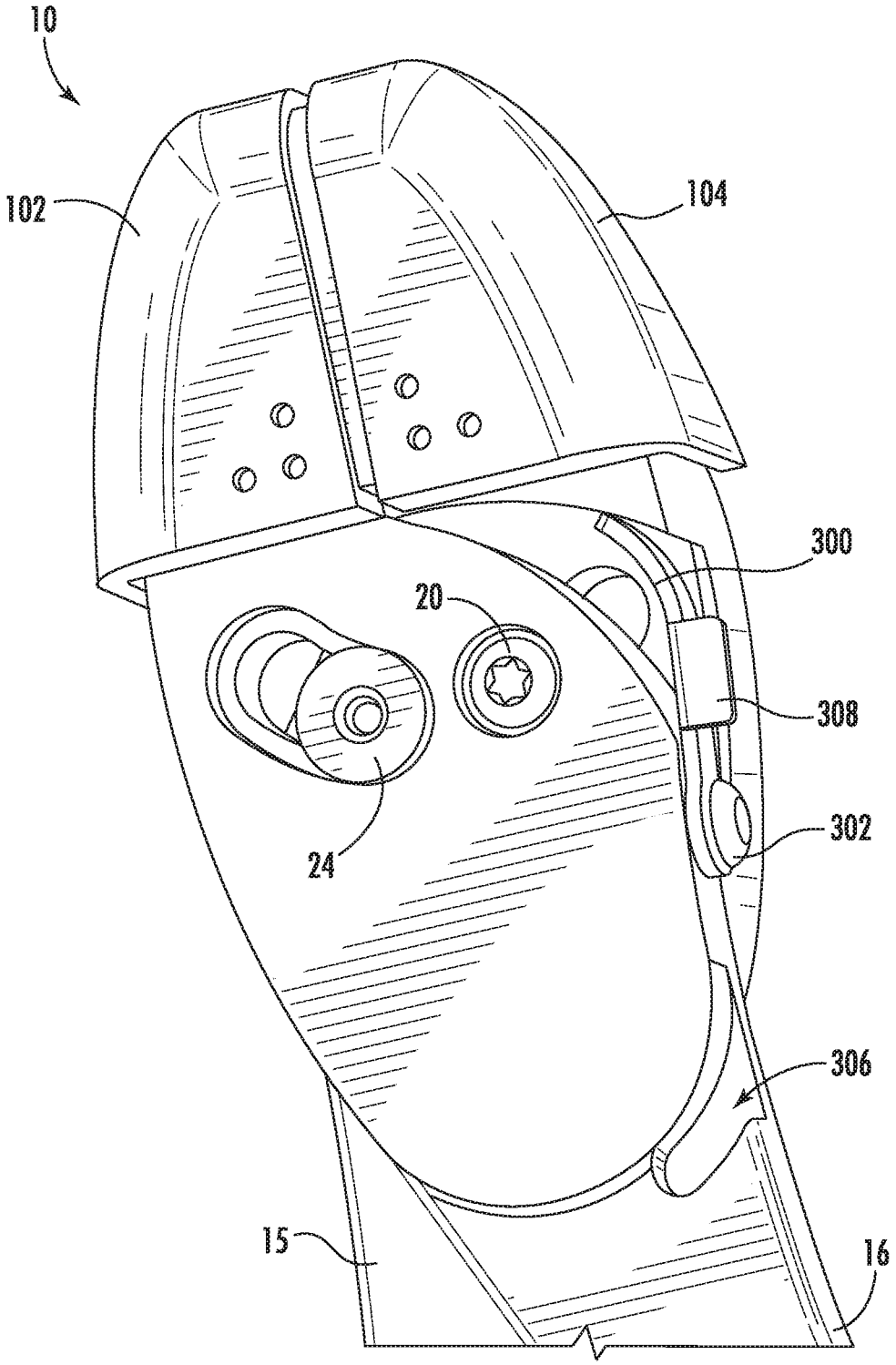
FIG. 7 is a perspective view of the hand tool of FIG. 6 with the lock in a locked position.

As mentioned above, the left handle 15 and the right handle 16 are pivotable through and within a first plane, e.g., the X-Y plane. As may be seen for example in FIGS. 4 through 7, the hand tool 10 may also include a lock 300 which is pivotable about a second pivot axis 301 between an unlocked position (FIGS. 4 and 6) and a locked position (FIGS. 5 and 7). The lock 300 may be partially received within a resting bay 306 when in the unlocked position. As illustrated in FIG. 4, the lock 300 may pivot along a path indicated by arrow 304 within the second plane. In the locked position, the handles 15, 16 and jaws 11, 13 are substantially or completely prevented from moving relative to one another, e.g., the above-described pivoting of the left handle 15 and the right handle 16 is inhibited or prevented when the lock 300 is in the locked position. For example, the lock 300 may extend into the joint 14 when in the locked position to prevent or inhibit movement of the hand tool 10 from the closed position to the open position. In some embodiments, e.g., as illustrated in FIG. 5, the lock 300 may be curved or contoured to match a corresponding shape of the joint 14 or a portion of the joint 14 with which the lock 300 engages when in the locked position. In the unlocked position, the lock 300 is clear of the joint 14 and does not interfere with the relative movement of the jaws 11, 13, or handles 15, 16.

The second pivot axis 301 may be oriented at an angle to the pivot axis 40 defined by the pivot joint 14, and the angle may be an oblique angle or a normal angle. For example, the second pivot axis 301 may be generally normal to the pivot axis 40 defined by the pivot joint 14, e.g., forming an angle of within ten degrees greater or less than ninety degrees (90°±10°). Similarly, the lock 300 may pivot through and within a second plane which is distinct from the first plane. For example, the second plane may be oriented at an angle to the first plane, such as an oblique angle or a normal angle. In at least some embodiments, the second plane may be a Y-Z plane defined by the vertical direction Y and the transverse direction Z, where the Y-Z plane is orthogonal to the X-Y plane. The hand tool 10 may advantageously permit one-handed operation, including locking and/or unlocking, of the hand tool 10. For example, the hand tool 10 may be configured to permit a user to hold the left handle 15 and right handle 16 in the fingers and palm of one of the user's hands while operating, e.g., pivoting, the lock 300 with the thumb of the one hand. The lock 300 may also include a thumb tab 308 (FIGS. 6 and 7) to promote engagement of the lock 300 with the user's thumb for one-handed locking/unlocking of the tool 10. The thumb tab 308 may extend from the lock 300 at about ninety degrees, for example, the thumb tab 308 may extend generally within the first plane.

Figure 8:
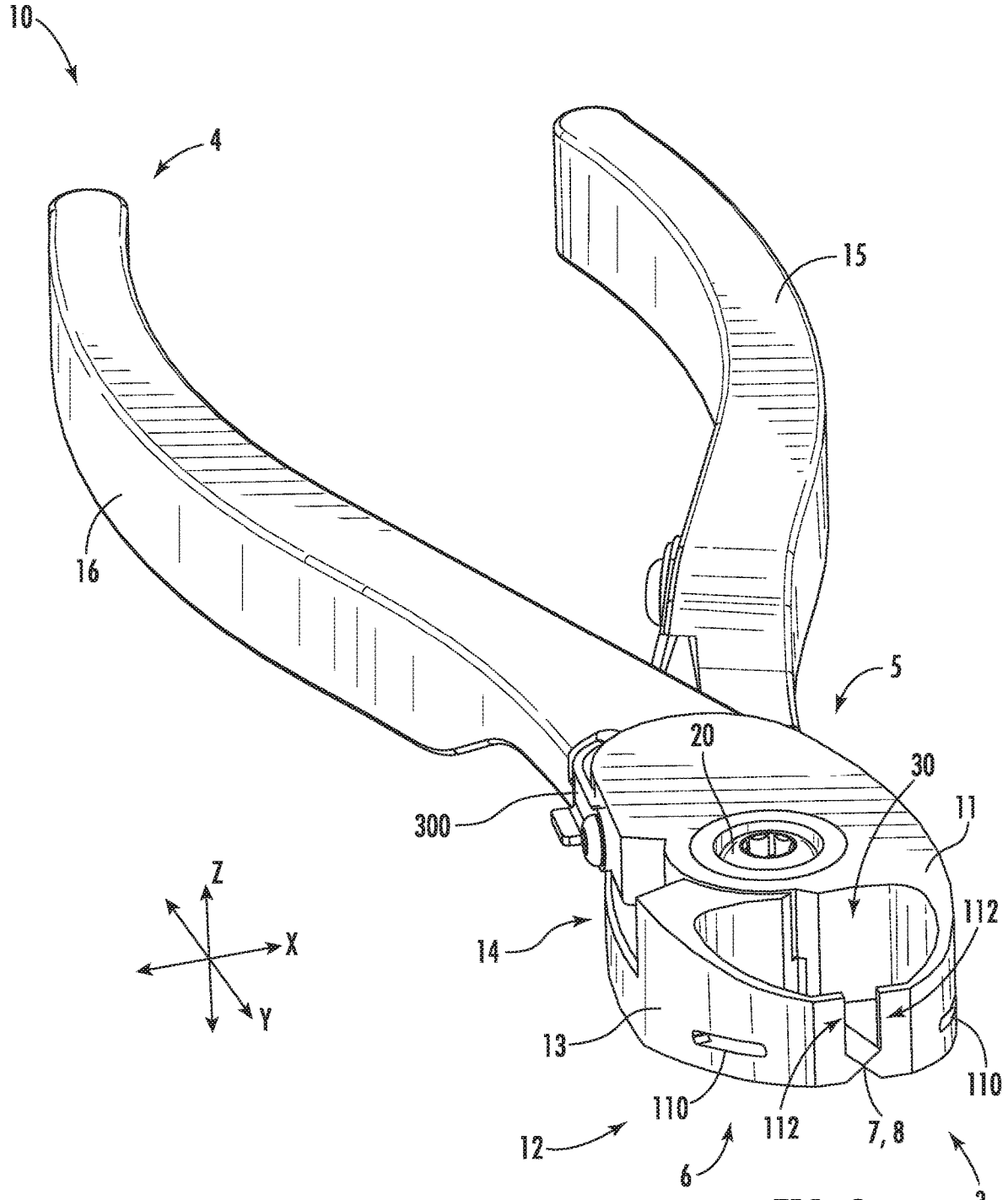
FIG. 8 illustrates a top perspective view of an exemplary hand tool according to one or more embodiments of the present disclosure.

FIG. 8 illustrates a top perspective view of an exemplary hand tool 10 according to one or more embodiments of the present disclosure. As may be seen in FIG. 8, the cutting edges 7 and 8 of the jaws 11 and 13 may be aligned when the head 12 of the tool is in the closed position. For example, the cutting edges 7 and 8 may be collinear and coextensive, such that the cutting edges 7 and 8 are aligned and in contact along their full extent. Also as may be seen in FIG. 8, the cutting edges 7, 8 are recessed within the head 12 of the tool 10. For example, the cutting edges 7, 8 may be recessed inward or backward along the transverse direction Z away from the front 5 and towards the back 6 of the tool 10.

As shown in FIGS. 2 and 4 through 7, the tool 10 may include an attached basket 100 to catch and contain cut pieces. The basket 100 may be removably attached to the hand tool 10. The basket 100 may be formed of any suitable material. For example, the basket 100 may advantageously promote visualization of the object to be cut and surrounding areas, such as by forming the basket 100 of a translucent or transparent material. For example, the basket 100 may be formed of a transparent plastic material.

Figure 9:
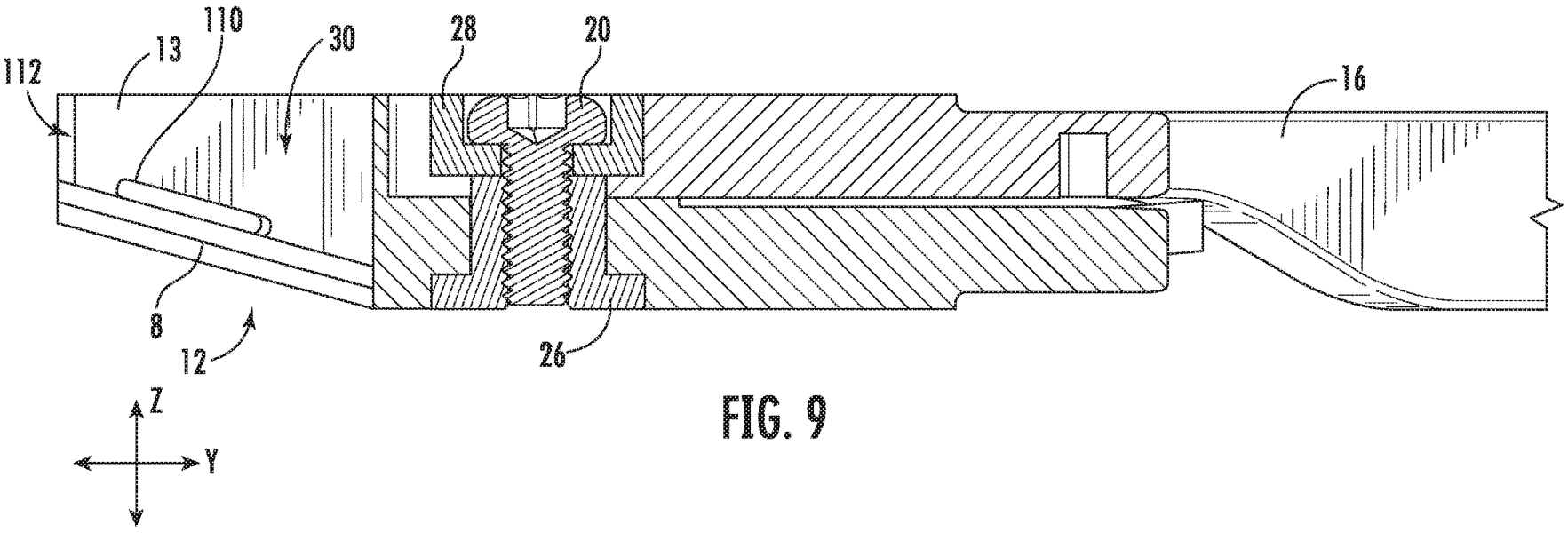
FIG. 9 provides a section view of a portion of an exemplary hand tool according to one or more embodiments of the present disclosure.

In particular, as illustrated in FIGS. 4 through 7, the basket 100 may include a left section 102 attached to the left jaw 11 and a right section 104 attached to the right jaw 13. FIG. 9 provides a section view of the head 12 of the tool 10. As may be seen in the section view of FIG. 9, the recess of the cutting edges 7 and 8 defines a chamber 30 within the head 12. The chamber 30 may cooperate with the basket 100 to capture and store cut pieces.

Figure 10:
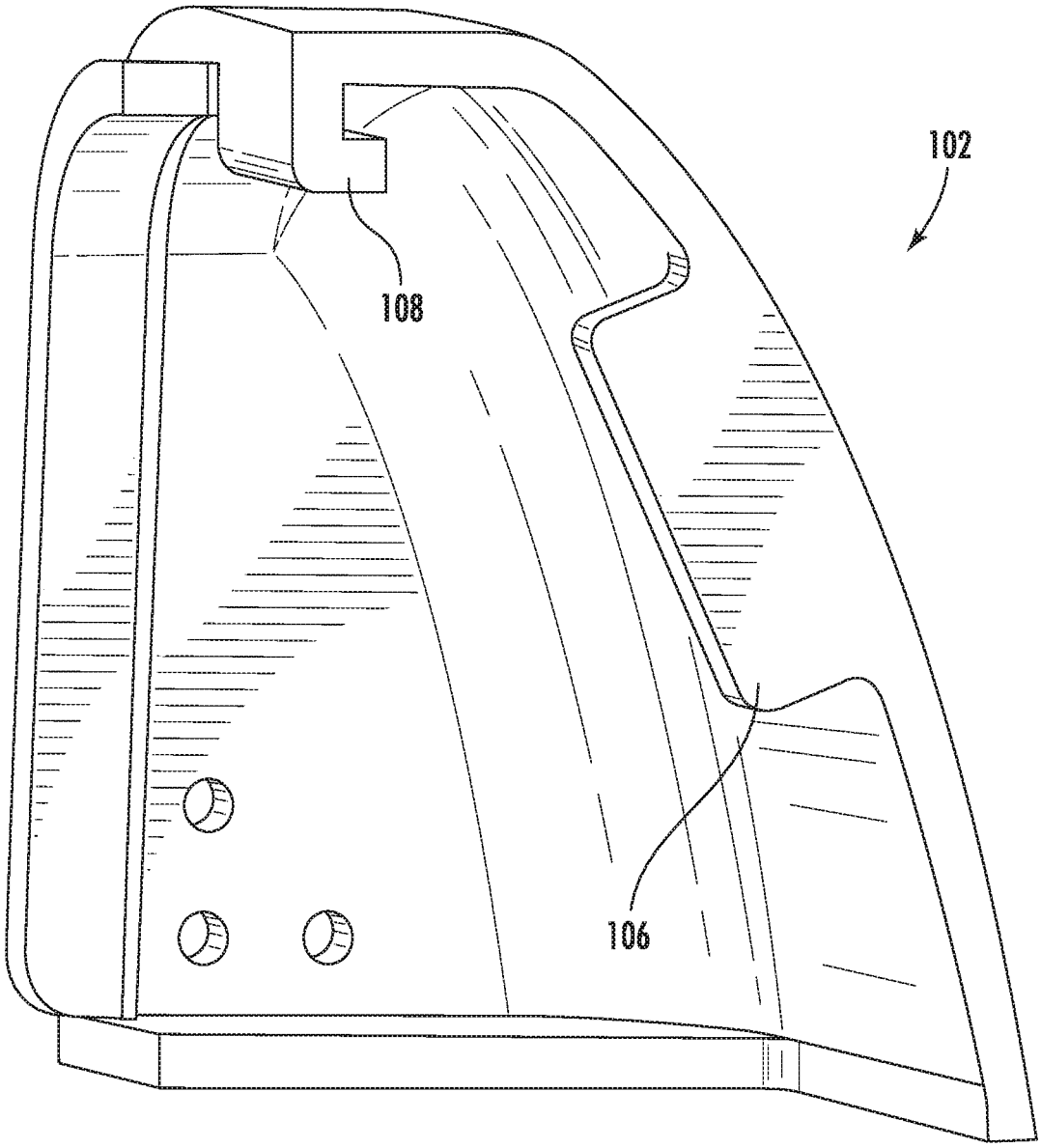
FIG. 10 provides a back perspective view of a left section of a basket for a hand tool according to one or more embodiments of the present disclosure.
Figure 11:
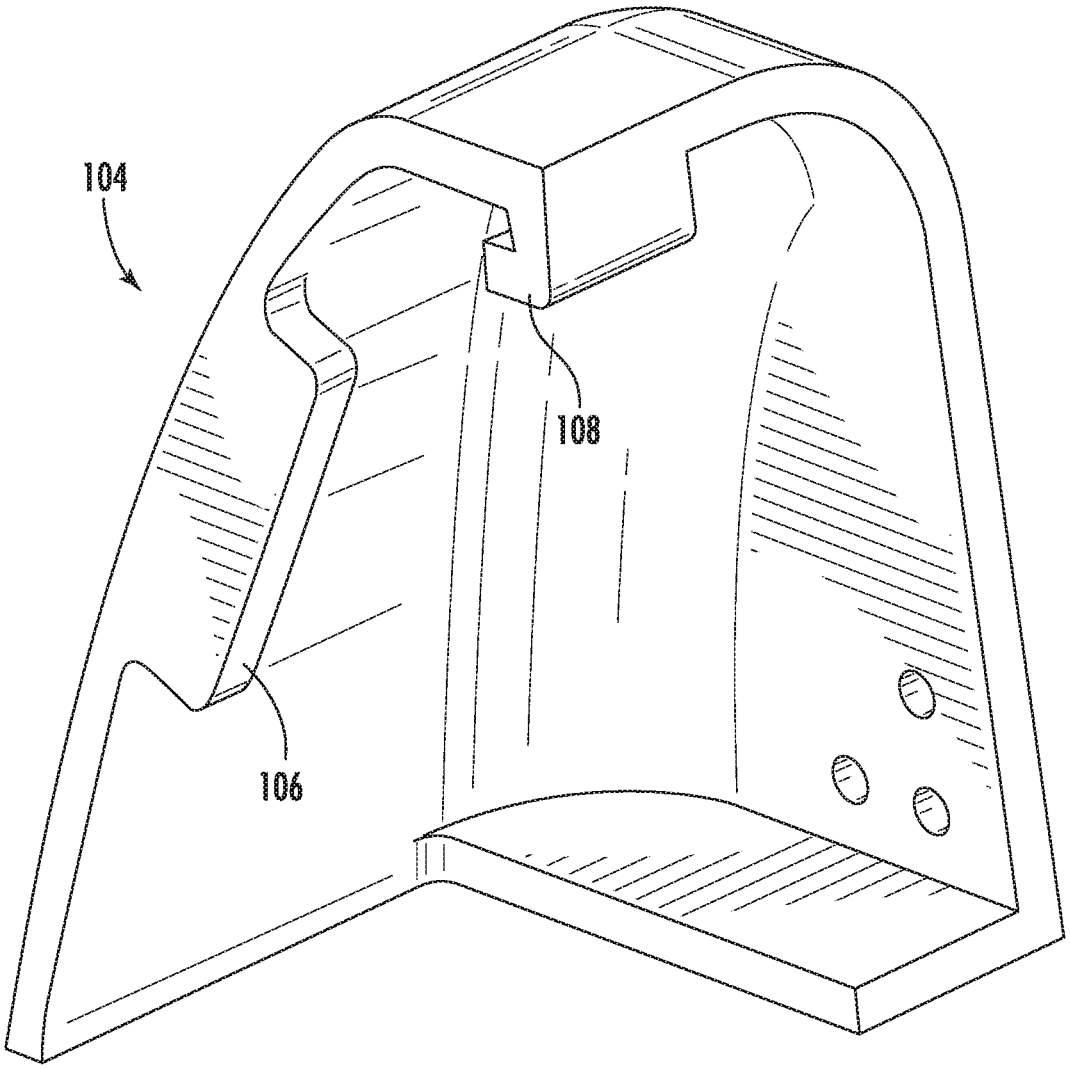
FIG. 11 provides a back perspective view of a right section of the basket for a hand tool according to one or more embodiments of the present disclosure.

As shown in FIG. 8, each of the jaws 11, 13 may include a slot 110 in an intermediate portion thereof and a notch 112 at an uppermost portion thereof. Accordingly, as may be seen in FIG. 8, when the tool 10 is in the closed position, the cutting edges 7 and 8 may be the only portions of the jaws 11 and 13 which touch, and/or the jaws 11, 13 may be spaced apart from each other forward (e.g., towards the front 5 along the transverse direction Z) of the cutting edges 7 and 8. FIG. 10 is a back perspective view of the left section 102 of the basket 100 and FIG. 11 is a back perspective view of the right section 104 of the basket 100. As may be seen in FIGS. 10 and 11, each section 102, 104 of the basket 100 may include a tab 106 and a hook 108. The tabs 106 of the basket sections 102, 104 may each fit in the slot 110 on the corresponding jaw 11 or 13 and the hooks 108 of the basket sections 102, 104 may each extend through and engage with the notches 112 in the corresponding jaw 11 or 13 when the basket 100 is attached to the tool 10.

Figure 12:
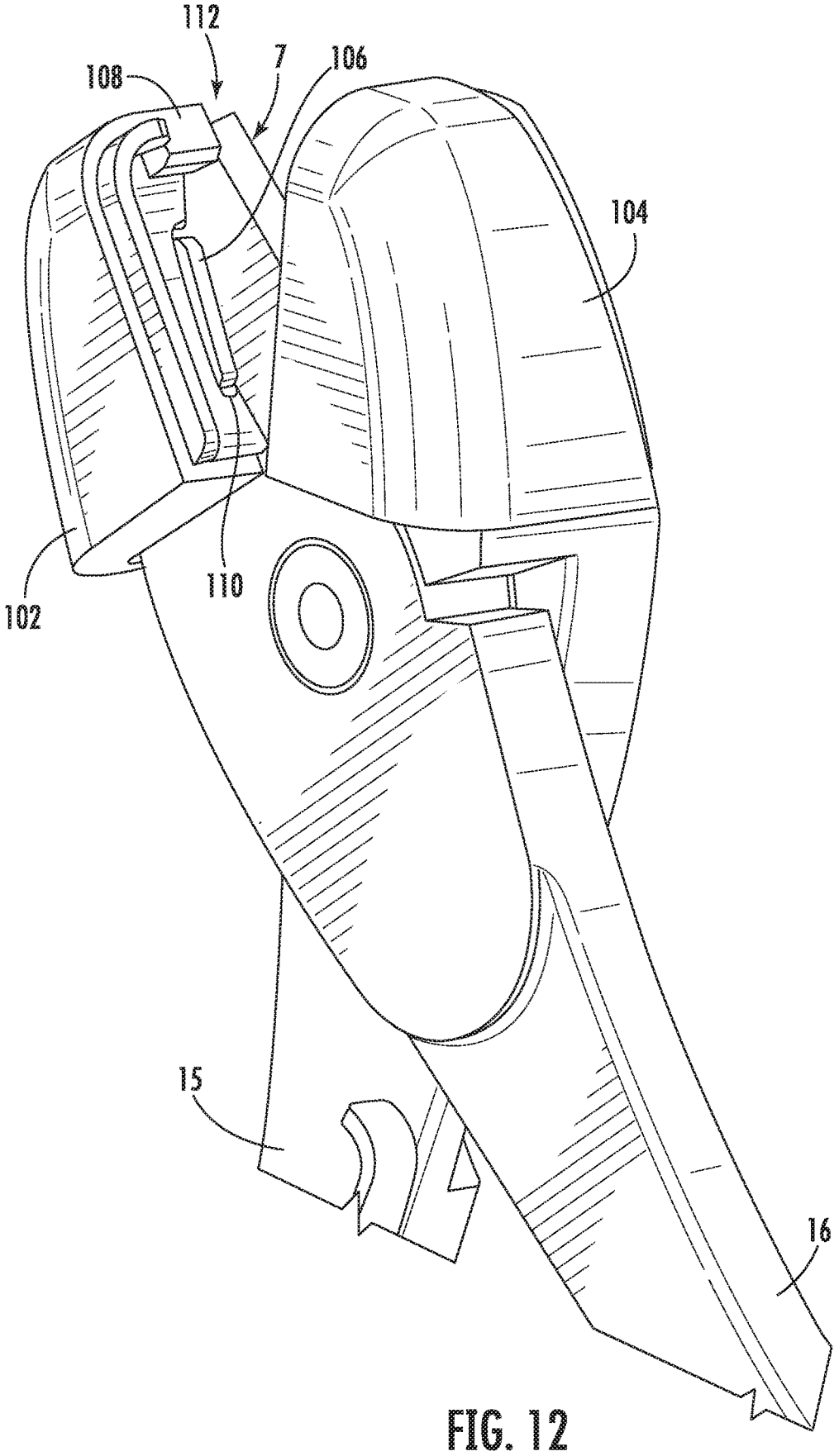
FIG. 12 illustrates a perspective view of a portion of an exemplary hand tool according to one or more embodiments of the present disclosure with a basket attached and the hand tool in an open position.

FIG. 12 illustrates a perspective view of a portion of the tool 10 with the basket 100 attached and the jaws 11 and 13 spaced apart, e.g., in an open or partially open position. With the jaws 11, 13 opened, the tab 106 of the left section 102 of the basket 100 may be seen positioned in the slot 110 of the left jaw 11 and the hook 108 of the left section 102 of the basket 100 may be seen engaged with the notch 112 of the left jaw 11. Additionally, it may be seen that the chamber 30 of the head 12 of the tool 10 is fully enclosed by the basket 100. Accordingly, with the basket 100 attached as illustrated in FIG. 12, the tool 10 may thereby catch and contain cut pieces, e.g., of wire, nail, or hook, as mentioned above, to prevent such pieces becoming lost or causing injuries.

Figure 13:
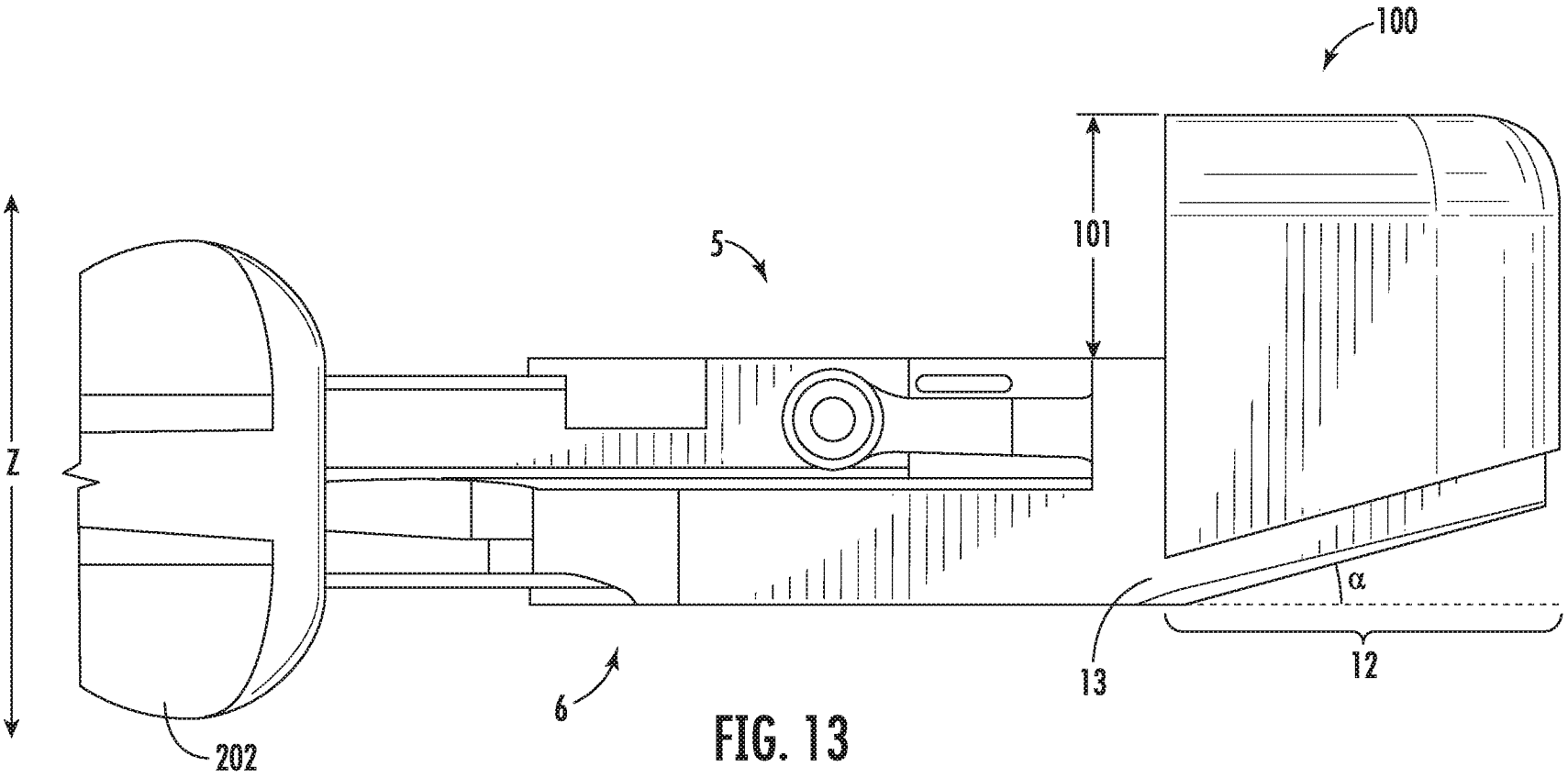
FIG. 13 provides a side view of a portion of an exemplary hand tool according to one or more embodiments of the present disclosure.
Figure 14:
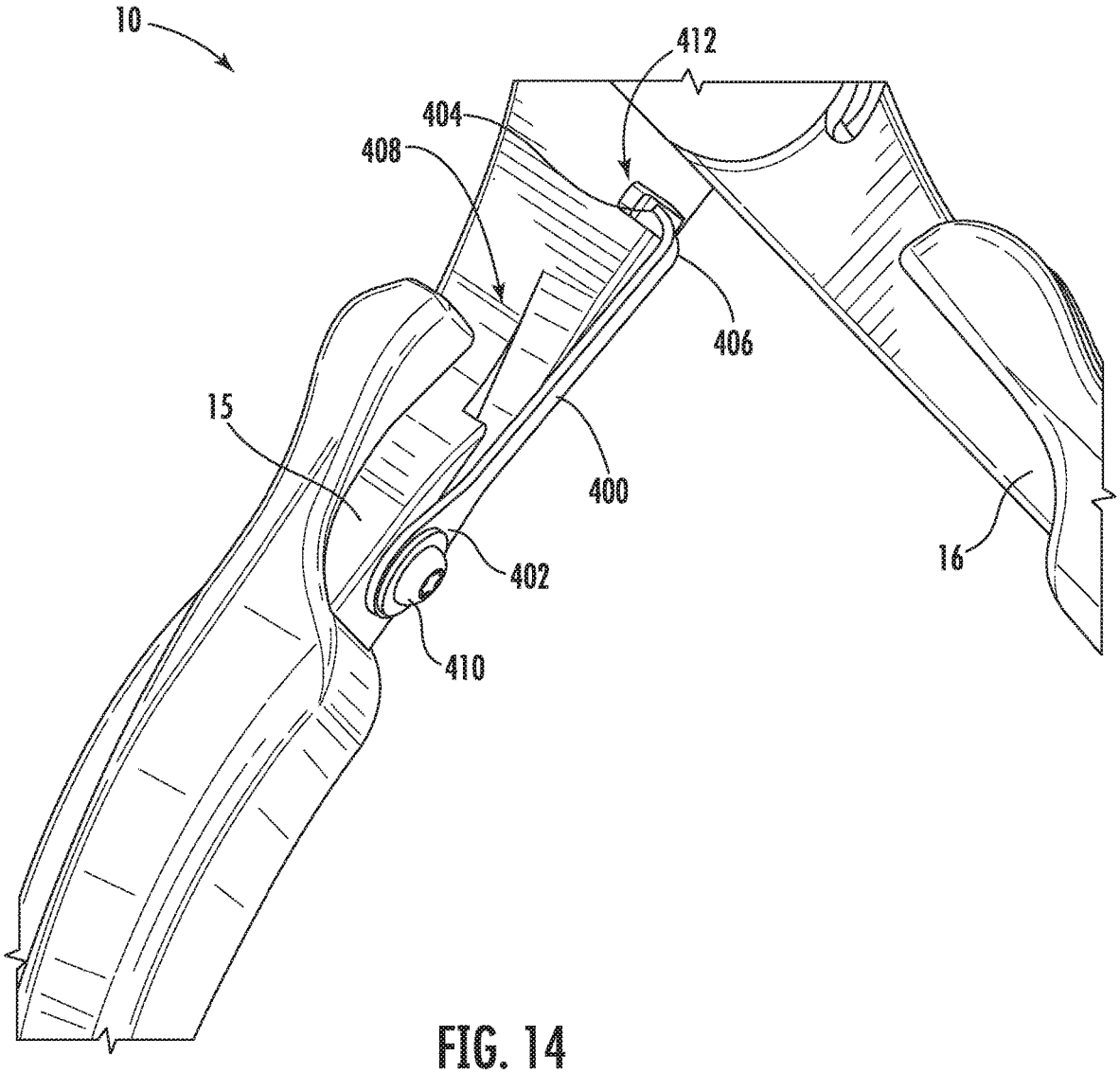
FIG. 14 provides a perspective view of a portion of an exemplary hand tool according to one or more embodiments of the present disclosure with a return spring in a disengaged position.
Figure 15:
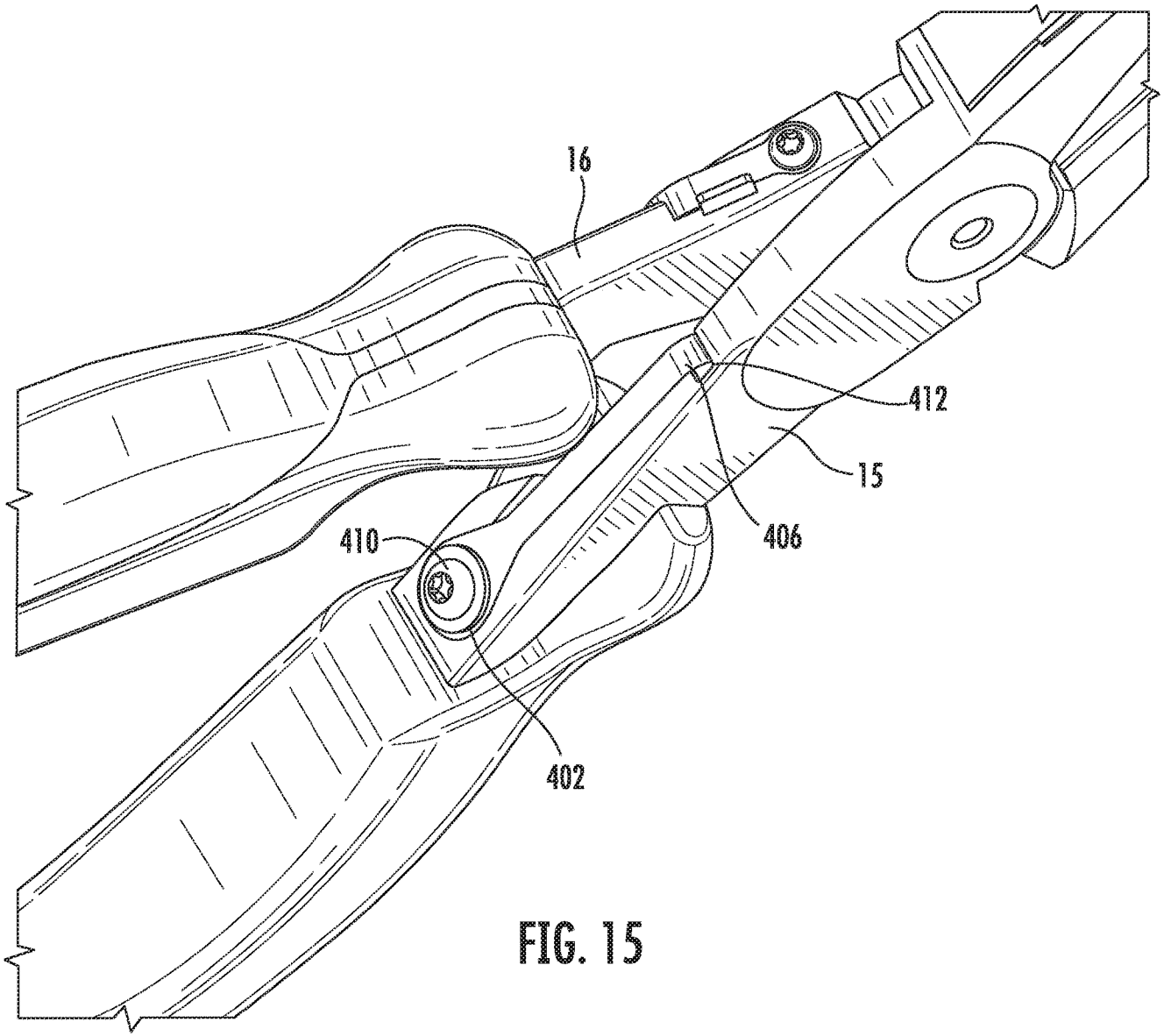
FIG. 15 provides a perspective view of a portion of an exemplary hand tool according to one or more embodiments of the present disclosure with a return spring in a disengaged position.

FIG. 13 provides a side view of the head 12 of the cutting tool 10 with another embodiment of the basket 100 attached. As compared to, e.g., the example embodiment illustrated in FIG. 2, in the example embodiment shown in FIG. 13 the basket 100 has an increased depth 101 along the transverse direction Z. Accordingly, the example basket 100 of the embodiment illustrated in FIG. 13 may provide increased storage volume, for example, as compared to the embodiment of, e.g., FIG. 2.

The tool 10 can also have dual action provided by one or more springs located between the handles. Dual action ensures that following a cut the jaws 11, 13 will open by merely releasing pressure on the handles 15, 16. Particularly when utilizing the tool 10 near a person's skin surface, it is beneficial to have a tool 10 that will automatically open at the cutting edges 7, 8 without the need for actively spreading the jaws 11 and 13 open. The dual action capability, e.g., by addition of the presence of one or more springs, can also reduce the hand fatigue of the operator.

As may be seen in FIGS. 14 through 17, in some embodiments, such dual action may be provided by a return spring 400 extending from an attachment point 402 on one of the left handle 15 and the right handle 16 to a return spring head 404. The attachment point 402 may be distal from the pivot joint 14 and the return spring head 404 may be proximate the pivot joint 14. The return spring 400 may be movably, e.g., rotatably, attached to the one of the left handle 15 and the right handle 16 at the attachment point 402, such as with a threaded fastener 410, as in the illustrated embodiment. Thus, the return spring 400 may be movable between a disengaged position (FIGS. 14 and 15) where the return spring 400 is stored in the one handle 15 or 16 and the other handle 15 or 16 may pivot freely without biasing from the return spring 400 and an engaged position (FIGS. 16 and 17) where the return spring 400 biases the other handle 15 or 16 away from the one handle 15 or 16, e.g., where the return spring 400 biases the tool 10 towards the open position from the closed position.

A return spring elbow 406 may define a bend in the return spring 400 proximate the return spring head 404. The bend may encompass an angle of about ninety degrees, e.g., forming an angle of within ten degrees greater or less than ninety degrees. The bend of the return spring elbow 406 may encompass any suitable angle as desired to promote biasing the left and right handles 15 and 16 to or towards the open position. The bend may include an arcuate portion as shown in the accompanying illustrated examples, or may define a sharper bend, e.g., a smaller radius bend, or a compound bend or any other suitable form.

As mentioned, the return spring 400 may be attached to one of the left handle 15 and the right handle 16. The one handle may define an incline 408 for the return spring 400 to be supported during activation to prevent displacement during usage and a resting recess 412 for the return spring head 404 when the return spring 400 is in the disengaged position. The other of the left handle 15 and the right handle 16 may include a trough 414 (FIG. 16) for the return spring elbow 406 to pivot during activation. As may be seen in FIG. 16, the trough 414 may define a sidewall 415, e.g., extending primarily in the X-Y plane with a minor dimension in the transverse direction Z, to prevent displacement of the return spring 400 during activation. For example, when in the engaged position, the return spring 400 may be engaged by the other of the left handle 15 and the right handle 16 as the handles 15, 16 approach each other when the hand tool 10 is moving towards the closed position from the open position. Due to such engagement, the return spring 400 may be deflected towards the one of the left handle 15 and the right handle 16, e.g., the return spring 400 may be pushed along the incline 408 on the one handle 15 or 16 by the trough 414 on the other handle 15 or 16. Thus, the return spring 400 may be constrained between the incline 408 and the trough 414, in particular the sidewall 415 of the trough 414, to prevent displacement during use. The trough 414, resting recess 412, and incline 408 may advantageously prevent or reduce contamination of the hand tool 10, e.g., with grease, dirt, bio-fluids, or other contaminants as may be found depending on the environment of use for the hand tool. For example, the trough 414, resting recess 412, and incline 408 may each be open on at least two sides to reduce the potential to trap contaminants within the hand tool 10.

The return spring 400 need not be exceptionally strong, particularly as an excessively strong spring action device will increase the compressive force needed to cut a material at the cutting edges 7, 8. The spring action device need only be strong enough to force the joint 14 to an open position upon release of pressure at the handles 15 and 16.

Figure 16:
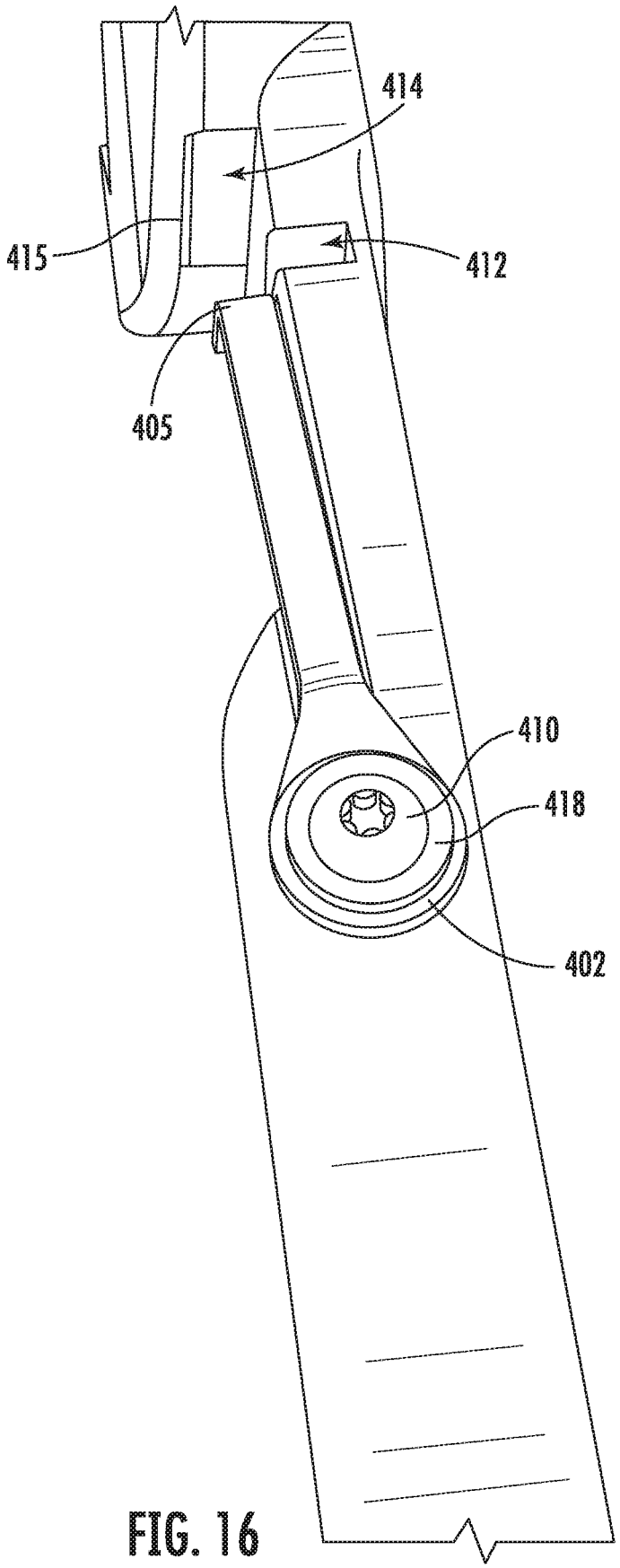
FIG. 16 provides a perspective view of a portion of an exemplary hand tool according to one or more embodiments of the present disclosure with a return spring in an engaged position.
Figure 17:
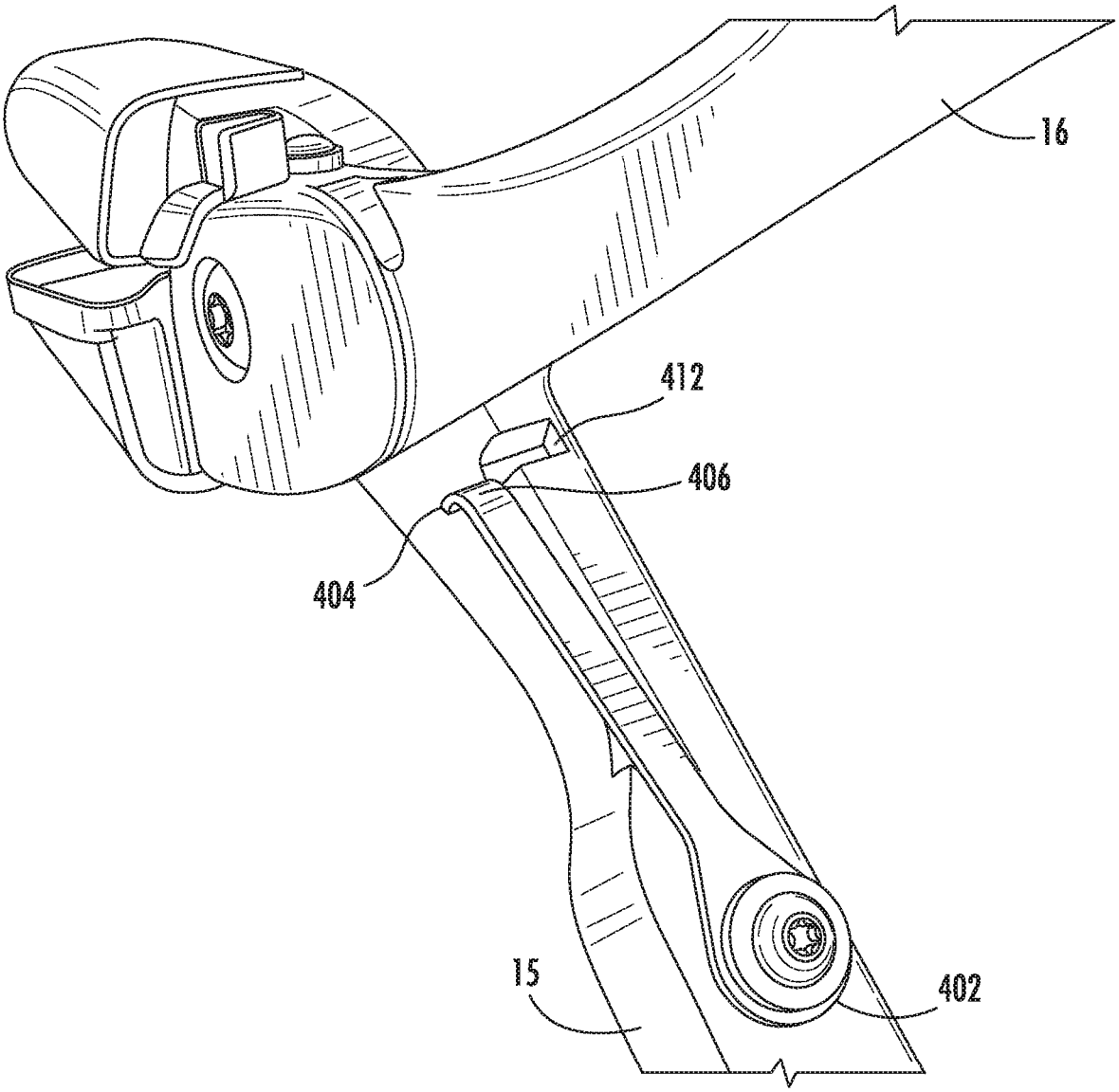
FIG. 17 provides a perspective view of a portion of an exemplary hand tool according to one or more embodiments of the present disclosure with a return spring in an engaged position.
Figure 18:
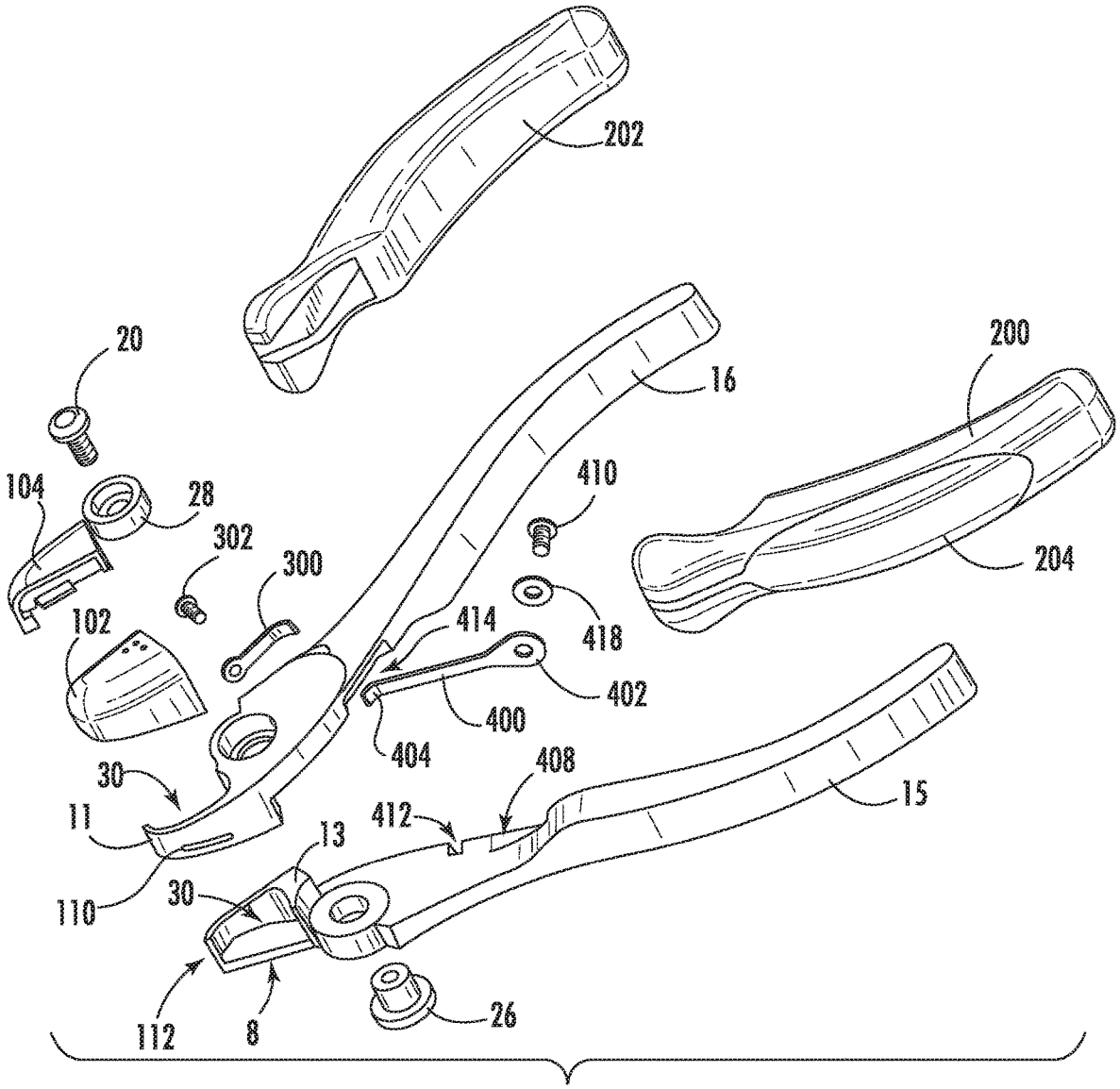
FIG. 18 provides an exploded view of an exemplary hand tool according to one or more embodiments of the present disclosure.

FIG. 18 provides an exploded view of an exemplary hand tool 10 according to one or more embodiments of the present disclosure. As may be seen in FIG. 18, the return spring 400 may be attached to the left handle 15 and may be attached with the fastener 410, e.g., a threaded fastener as depicted in FIG. 18. Additionally, a washer 418 may be provided between the fastener 410 and the return spring 400 to promote rotation of the return spring 400, e.g., between the disengaged position (FIGS. 14 and 15) and the engaged position (FIGS. 16 and 17). Also as may be seen in FIG. 18, the joint 14 may include a removable fastener, e.g., threaded fastener 20. In some embodiments, the threaded fastener 20 may be a male fastener having external threads and may be threadedly engageable with a female fastener 26 having internal threads. Additionally, a washer or grommet 28 may be provided to promote rotation of the pivot joint 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A hand tool, comprising:

a head comprising a pair of opposing jaws, each jaw comprising a cutting edge;

a first handle;

a second handle joined to the first handle at a pivot joint, whereby the first handle and the second handle are each rotatable relative to the other to move the hand tool between a closed position where the jaws are in contact and an open position where the jaws are spaced apart; and a lock pivotably attached to one of the first handle and the second handle whereby the lock is rotatable between a locked position where movement of the hand tool from the closed position to the open position is inhibited by the lock and an unlocked position where the lock does not interfere with relative rotation of the first handle and the second handle;

wherein the first handle and the second handle are rotatable between the open position and the closed position in a first direction, the lock is rotatable between the locked position and the unlocked position in a second direction, and the second direction is oblique or normal to the first direction;

wherein the first handle comprises and inner side and an outer side opposite the inner side of the first handle, the second handle comprises an inner side and an outer side opposite the inner side of the second handle, the inner side of the first handle and the inner side of the second handle each facing towards the other, and the outer side of the first handle and the outer side of the second handle each facing away from the other;

wherein the lock is pivotably attached to the one of the first handle and the second handle at the outer side of the one of the first handle and the second handle, the outer side of the one of the first handle and the second handle facing away from both the inner side and the outer side of the other of the first handle and the second handle along the first direction.

2. The hand tool of claim 1, wherein the second direction is normal to the first direction.

3. The hand tool of claim 1, further comprising a return spring rotatably attached to one of the first handle and the second handle, the return spring rotatable relative to the one of the first handle and the second handle between an engaged position and a disengaged position.

4. The hand tool of claim 3, wherein the one of the first handle and the second handle comprises an incline, the incline supporting the return spring during activation when the return spring engages the other of the first handle and the second handle such that the return spring is displaced towards the one of the first handle and the second handle.

5. The hand tool of claim 3, wherein the return spring comprises a return spring head and the one of the first handle and the second handle comprises a resting recess, the return spring head received within the resting recess when the return spring is in the disengaged position.

6. The hand tool of claim 1, further comprising a basket removably attached to the head.

7. The hand tool of claim 6, wherein the cutting edges are recessed within the head to form a chamber in the head, and wherein the chamber is fully enclosed by the basket when the basket is attached to the head.

8. The hand tool of claim 6, wherein the basket comprises a first section removably attached to one of the pair of opposing jaws and a second section removably attached to the other of the pair of opposing jaws.

9. The hand tool of claim 1, wherein the joint is a removable joint configured for non-destructive disassembly of the hand tool for cleaning.

10. The hand tool of claim 1, wherein the head of the hand tool is tilted at an angle of about fifteen degrees relative to the first direction.

11. The hand tool of claim 1, wherein the jaws are in contact along the cutting edges when the hand tool is in the closed position.

12. A hand tool, comprising:

a head comprising a pair of opposing jaws, each jaw comprising a cutting edge;

a first handle;

a second handle joined to the first handle at a pivot joint, whereby the first handle and the second handle are each rotatable relative to the other to move the hand tool between a closed position where the jaws are in contact and an open position where the jaws are spaced apart; and a lock pivotably attached to one of the first handle and the second handle whereby the lock is rotatable between a locked position where movement of the hand tool from the closed position to the open position is inhibited by the lock and an unlocked position where the lock does not interfere with relative rotation of the first handle and the second handle;

wherein the first handle and the second handle are rotatable between the open position and the closed position about a first pivot axis, the lock is rotatable between the locked position and the unlocked position about a second pivot axis, and the second pivot axis is oblique or normal to the first pivot axis;

wherein the first handle comprises and inner side and an outer side opposite the inner side of the first handle, the second handle comprises an inner side and an outer side opposite the inner side of the second handle, the inner side of the first handle and the inner side of the second handle each facing towards the other, and the outer side of the first handle and the outer side of the second handle each facing away from the other;

wherein the lock is pivotably attached to the one of the first handle and the second handle at the outer side of the one of the first handle and the second handle, the outer side of the one of the first handle and the second handle facing away from both the inner side and the outer side of the other of the first handle and the second handle along a direction that is parallel to the second pivot axis.

13. The hand tool of claim 12, further comprising a return spring rotatably attached to one of the first handle and the second handle, the return spring rotatable relative to the one of the first handle and the second handle between an engaged position and a disengaged position.

14. The hand tool of claim 13, wherein the one of the first handle and the second handle comprises an incline, the incline supporting the return spring during activation when the return spring engages the other of the first handle and the second handle such that the return spring is displaced towards the one of the first handle and the second handle.

15. The hand tool of claim 13, wherein the return spring comprises a return spring head and the one of the first handle and the second handle comprises a resting recess, the return spring head received within the resting recess when the return spring is in the disengaged position.

16. The hand tool of claim 12, wherein the joint is a removable joint configured for non-destructive disassembly of the hand tool for cleaning.

17. The hand tool of claim 12, wherein the head of the hand tool is tilted at an angle of about fifteen degrees relative to the first handle and the second handle.

18. The hand tool of claim 12, wherein the jaws are in contact along the cutting edges when the hand tool is in the closed position.

* * * * *